US007111960B2

(12) United States Patent
Jetland

(10) Patent No.: US 7,111,960 B2
(45) Date of Patent: Sep. 26, 2006

(54) UTILITY LAMP SYSTEM

(76) Inventor: David W. Jetland, 106 NW. 16th Ave., Grand Rapids, MN (US) 55744

( * ) Notice: Subject to any disclaimer, the term of this patent is extended or adjusted under 35 U.S.C. 154(b) by 185 days.

(21) Appl. No.: 10/234,074

(22) Filed: Aug. 29, 2002

(65) Prior Publication Data

US 2004/0042221 A1 Mar. 4, 2004

(51) Int. Cl.
*F21V 21/08* (2006.01)
*F21V 14/02* (2006.01)

(52) U.S. Cl. ..... 362/186; 362/285; 362/287; 362/419

(58) Field of Classification Search ..... 362/396, 362/486, 260, 340, 386, 147, 35, 285, 287, 362/419
See application file for complete search history.

(56) References Cited

U.S. PATENT DOCUMENTS

| | | | | |
|---|---|---|---|---|
| 1,271,835 | A | 7/1918 | Benjamin | |
| 3,872,428 | A * | 3/1975 | Boisvert | 362/396 |
| 4,136,381 | A | 1/1979 | Bone | 362/311 |
| 4,310,874 | A | 1/1982 | Spiteri | 362/251 |
| 4,999,752 | A | 3/1991 | Rogers et al. | 362/228 |
| 5,209,562 | A | 5/1993 | Glassford | 362/378 |
| 5,400,234 | A * | 3/1995 | Yu | 362/396 |
| D360,952 | S | 8/1995 | Lee | D26/60 |
| D367,540 | S | 2/1996 | Lee | D26/63 |
| 5,510,970 | A | 4/1996 | Hollenbach et al. | 362/396 |
| 5,548,496 | A | 8/1996 | Hart et al. | 362/396 |
| 5,567,045 | A * | 10/1996 | Bueck | 362/363 |
| 5,602,948 | A | 2/1997 | Currie | 585/33 |
| 5,645,341 | A | 7/1997 | Liao | 362/183 |
| 5,673,989 | A * | 10/1997 | Gohl et al. | 362/35 |
| 5,769,526 | A | 6/1998 | Shaffer | 362/80 |
| 5,769,535 | A | 6/1998 | Rominger et al. | 362/396 |
| 5,961,207 | A | 10/1999 | Petkovic | 362/376 |
| 6,062,703 | A * | 5/2000 | Tsao | 362/184 |
| 6,123,434 | A * | 9/2000 | Meltzer | 362/260 |
| 6,315,431 | B1 | 11/2001 | Greedy | 362/253 |
| 6,467,928 | B1 * | 10/2002 | Crelin | 362/147 |

OTHER PUBLICATIONS

Northern Tool & Equipment Company, Clip-On Work Light, p. 267, Item F.
Xtreme White Web Page, FIZZ Battery Checker Lamp.
J & S Distributors, Apr. 25, 2002, Bright Bar.

* cited by examiner

*Primary Examiner*—Sandra O'Shea
*Assistant Examiner*—Anabel Ton
(74) *Attorney, Agent, or Firm*—Jerold M. Forsberg

(57) ABSTRACT

A utility lamp system for use in outdoor and indoor locations in a convenient manner. The device includes a main housing with an electrical receptacle within, a clamp structure movably attached to the main housing, a bulb housing extending from the main housing, and a cover pivotally attached to a lower end of the bulb housing.

13 Claims, 7 Drawing Sheets

UTILITY LAMP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to utility lamps and more specifically it relates to a utility lamp system for use in outdoor and indoor locations in a convenient manner.

2. Description of the Related Art

Examples of patented devices which may be related to the present invention include U.S. Pat. No. 6,062,703 to Tsao; U.S. Pat. No. 360,952 to Lee; U.S. Pat. No. 6,315,431 to Greedy; U.S. Pat. No. 5,209,562 to Glassford; U.S. Pat. No. 5,769,535 to Rominger et al.; U.S. Pat. No. 367,540 to Lee; U.S. Pat. No. 5,961,207 to Petkovic; U.S. Pat. No. 5,769,526 to Shaffer; U.S. Pat. No. 5,548,496 to Hart et al.; U.S. Pat. No. 5,510,970 to Hollenbach et al.; U.S. Pat. No. 5,645,341 to Liao; U.S. Pat. No. 5,602,948 to Currie; U.S. Pat. No. 4,999,752 to Rogers et al.; and U.S. Pat. No. 4,310,874 to Spiteri.

While these lamp devices may be suitable for the particular purpose to which they address, they are not as suitable for use in outdoor and indoor locations in a convenient manner. Conventional lamp devices are not suitable for usage within both outdoor and indoor locations for extended periods of time.

In these respects, the utility lamp system according to the present invention substantially departs from the conventional methods of use and structures of the prior art, and in so doing provides a lamp device primarily developed for the purpose of use in outdoor and indoor locations in a convenient manner.

BRIEF SUMMARY OF THE INVENTION

In view of the foregoing disadvantages inherent in the known types of lamp devices now present in the prior art, the present invention provides a new utility lamp system wherein the same can be utilized for use in outdoor and indoor locations in a convenient manner.

The general purpose of the present invention, which will be described subsequently in greater detail, is to provide a new utility lamp system that has many of the advantages of the lamp devices mentioned heretofore and many novel features and functions that result in a new utility lamp system which is not anticipated, rendered obvious, suggested, or even implied by any of the prior art lamp devices, either alone or in any combination thereof. To attain this, the present invention generally comprises a main housing with an electrical receptacle within, a clamp structure movably attached to the main housing, a bulb housing extending from the main housing, and a cover pivotally attached to a lower end of the bulb housing.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a utility lamp system that will overcome the shortcomings of the prior art.

Another object is to provide a utility lamp system for use in outdoor and indoor locations in a convenient manner.

An additional object is to provide a utility lamp system that may be electrically powered via a battery or a cigarette lighter connection.

A further object is to provide a utility lamp system that may be utilized within various environments to illuminate an area such as an ice fishing house, a tent or vehicle.

Another object is to provide a utility lamp system that is durable and compact.

A further object is to provide a utility lamp system that is water resistant.

Another object is to provide a utility lamp system that attaches to various structures.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific use illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
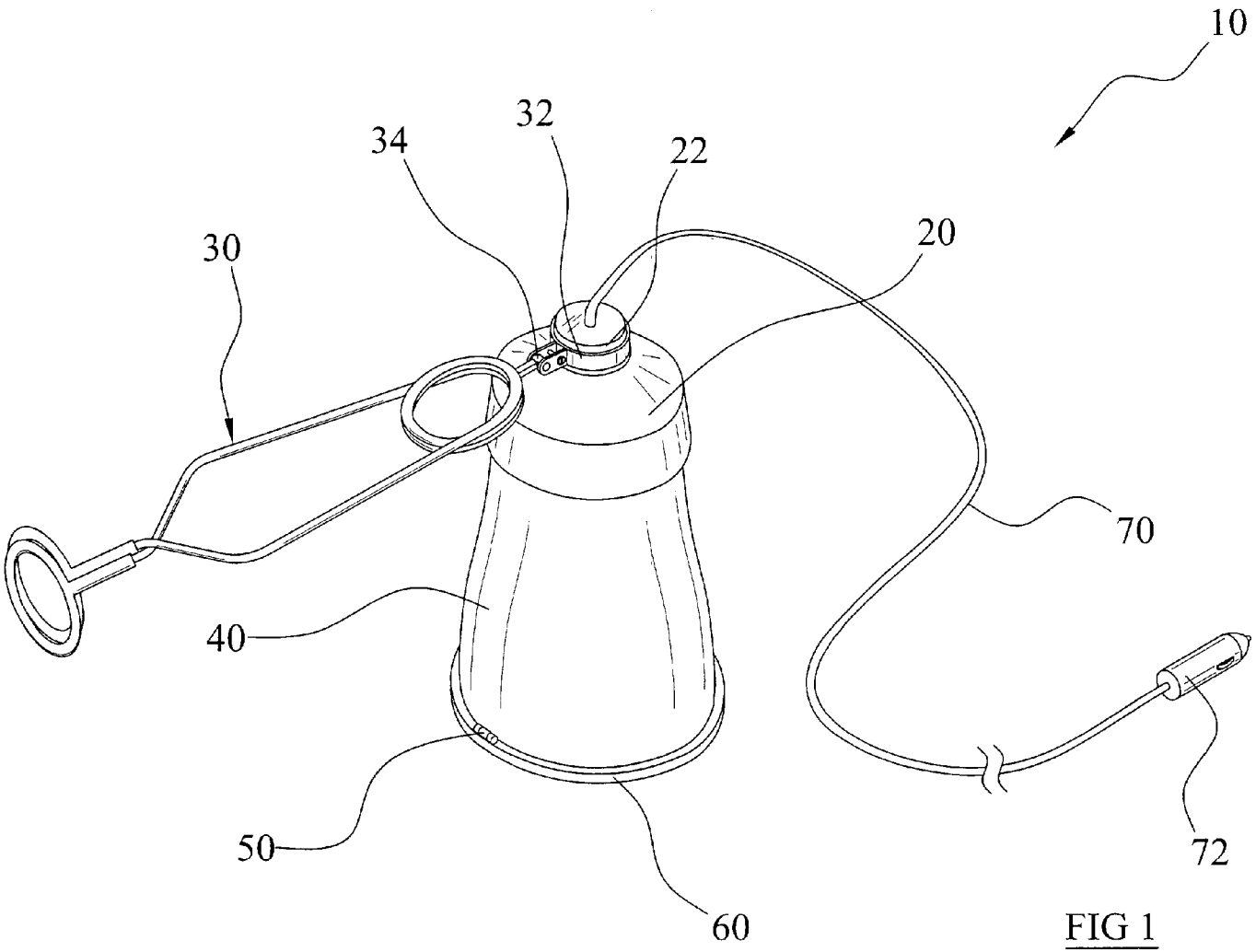
FIG. 1 is an upper perspective view of the present invention.

Turning now descriptively to the drawings, in which similar reference characters denote similar elements throughout the several view, FIGS. 1 through 6 illustrate a utility lamp system 10, which comprises a main housing 20 with an electrical receptacle within, a clamp structure 30 movably attached to the main housing 20, a bulb housing 40 extending from the main housing 20, and a cover 60 pivotally attached to a lower end 44 of the bulb housing 40.

Figure 3:
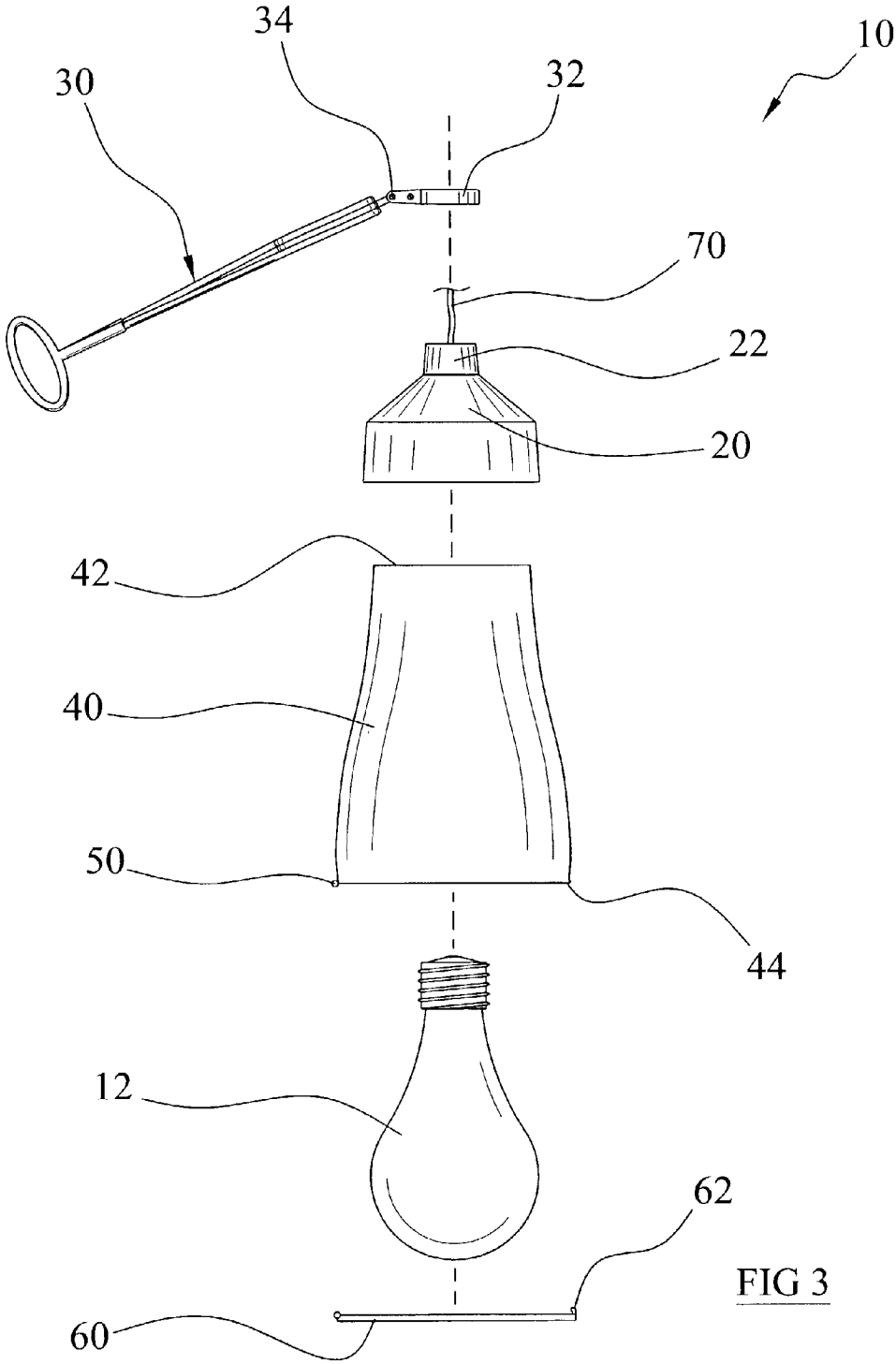
FIG. 3 is an exploded side view of the present invention.
Figure 6:
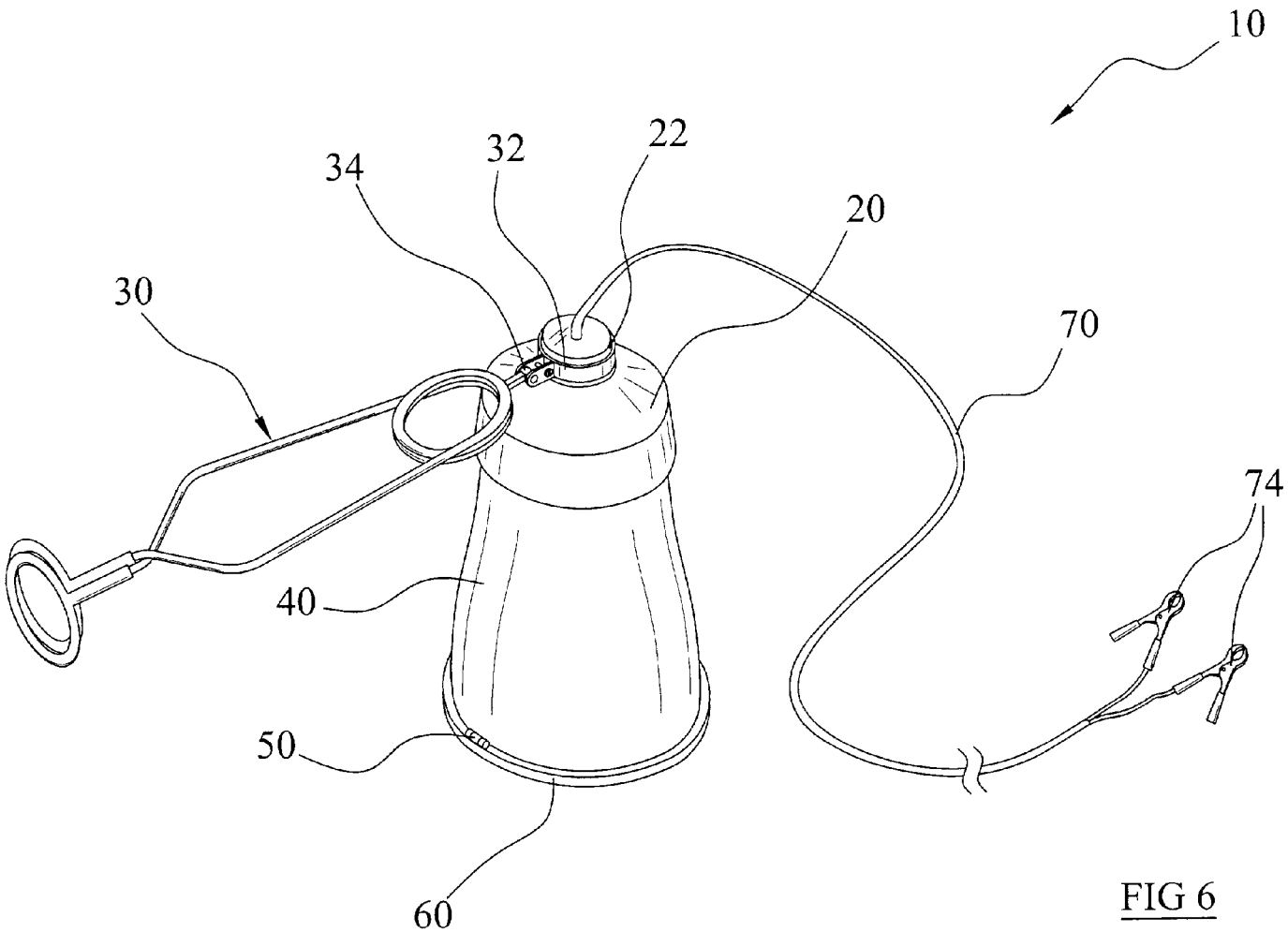
FIG. 6 is an upper perspective view of an alternative embodiment of the present invention.

As shown in FIG. 3 of the drawings, the main housing 20 has an upper neck 22 that is narrower than a main portion of the main housing 20. The main housing 20 has an electrical receptacle within for threadably and electrically receiving a conventional light bulb 12. A power cord 70 is electrically connected to the electrical receptacle for providing either DC or AC electrical power to the light bulb 12. An adapter unit 72 is preferably electrically connected to the distal end of the power cord 70 for electrically connecting to a cigarette lighter receptacle within a vehicle or similar power receptacle. FIG. 6 illustrates the usage of a pair of electrical clamps 74 for directly connecting to a battery.

Figure 4:
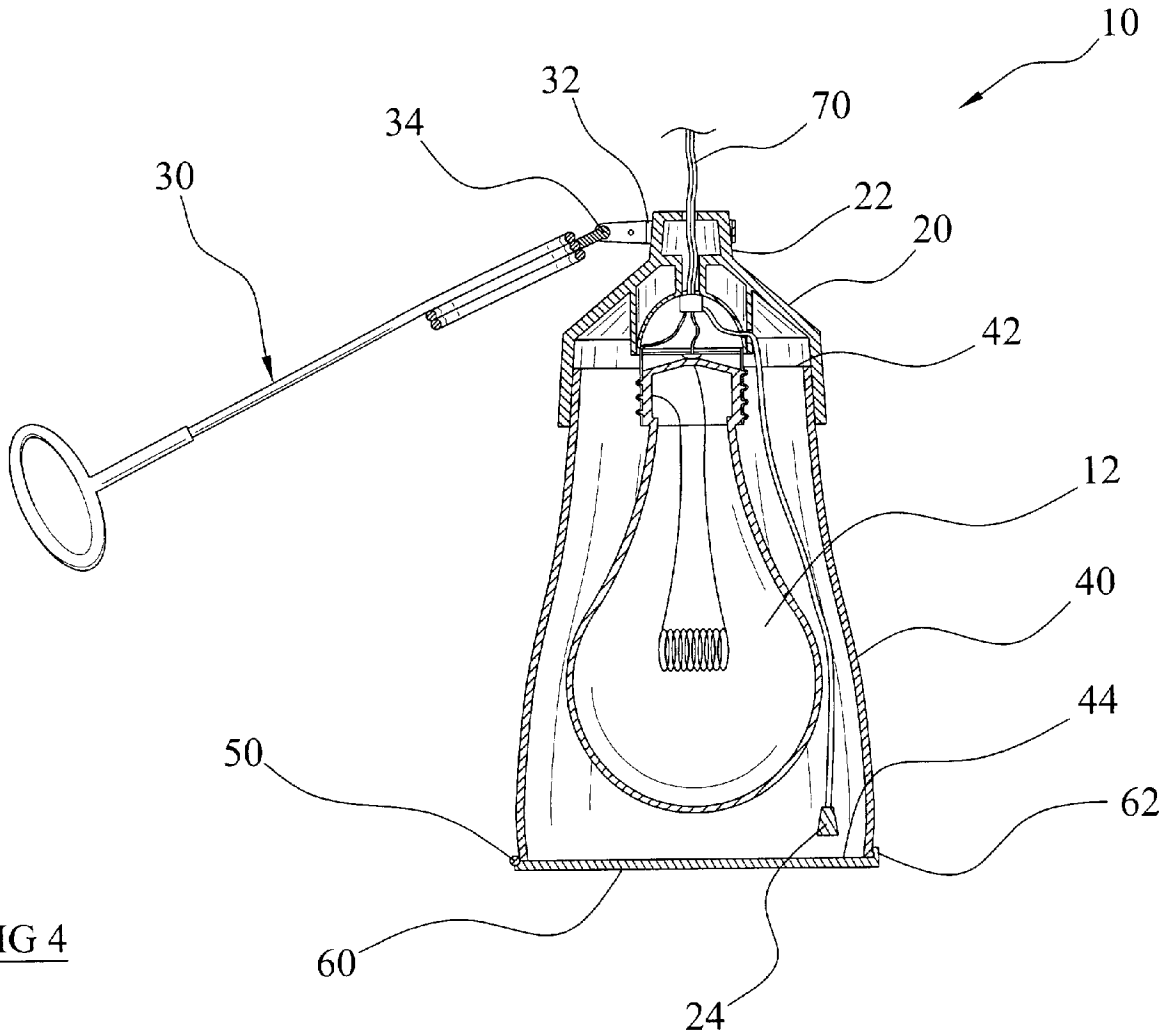
FIG. 4 is a side cutaway view of the present invention.
Figure 5:
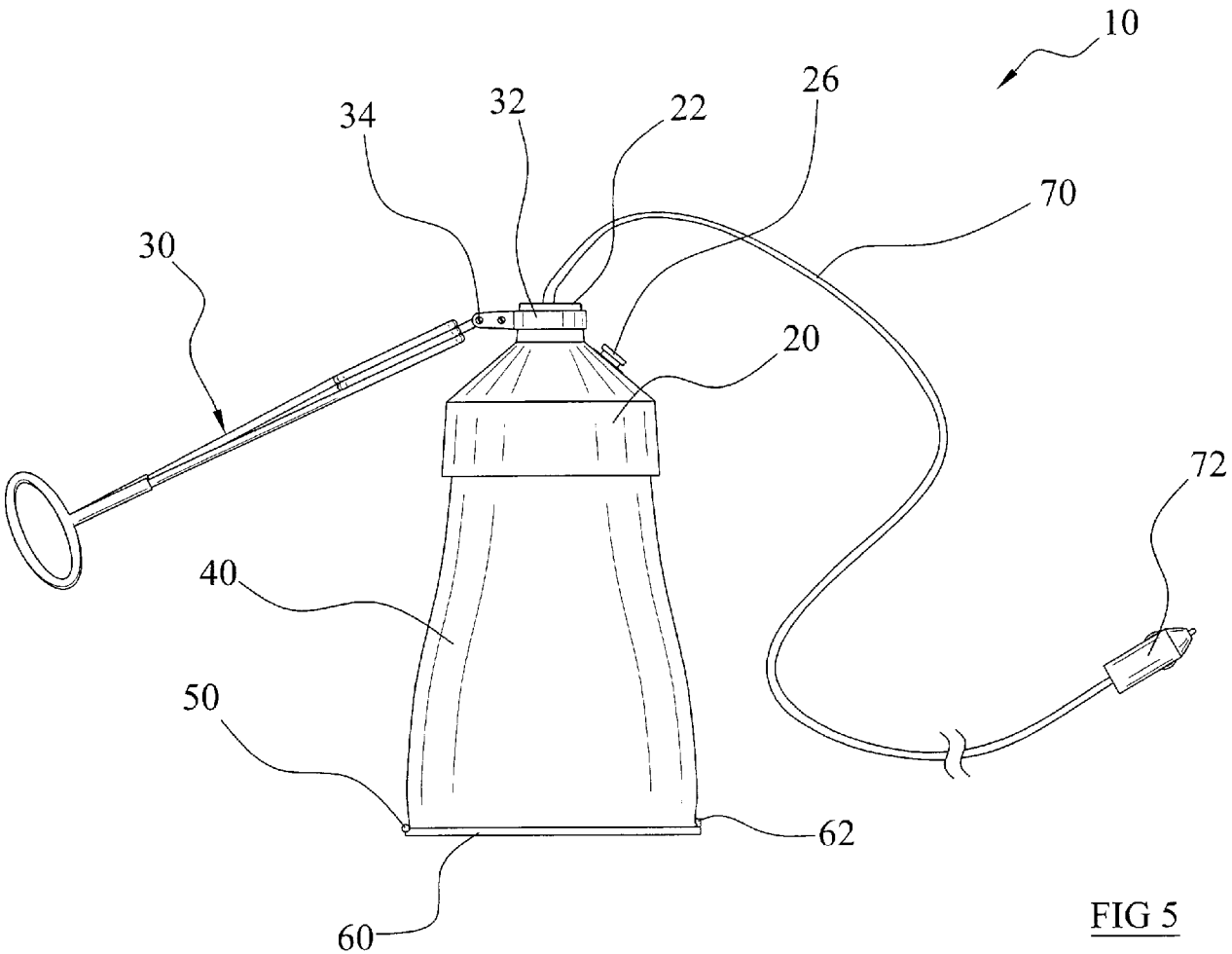
FIG. 5 is a side view of the present invention.
Figure 7:
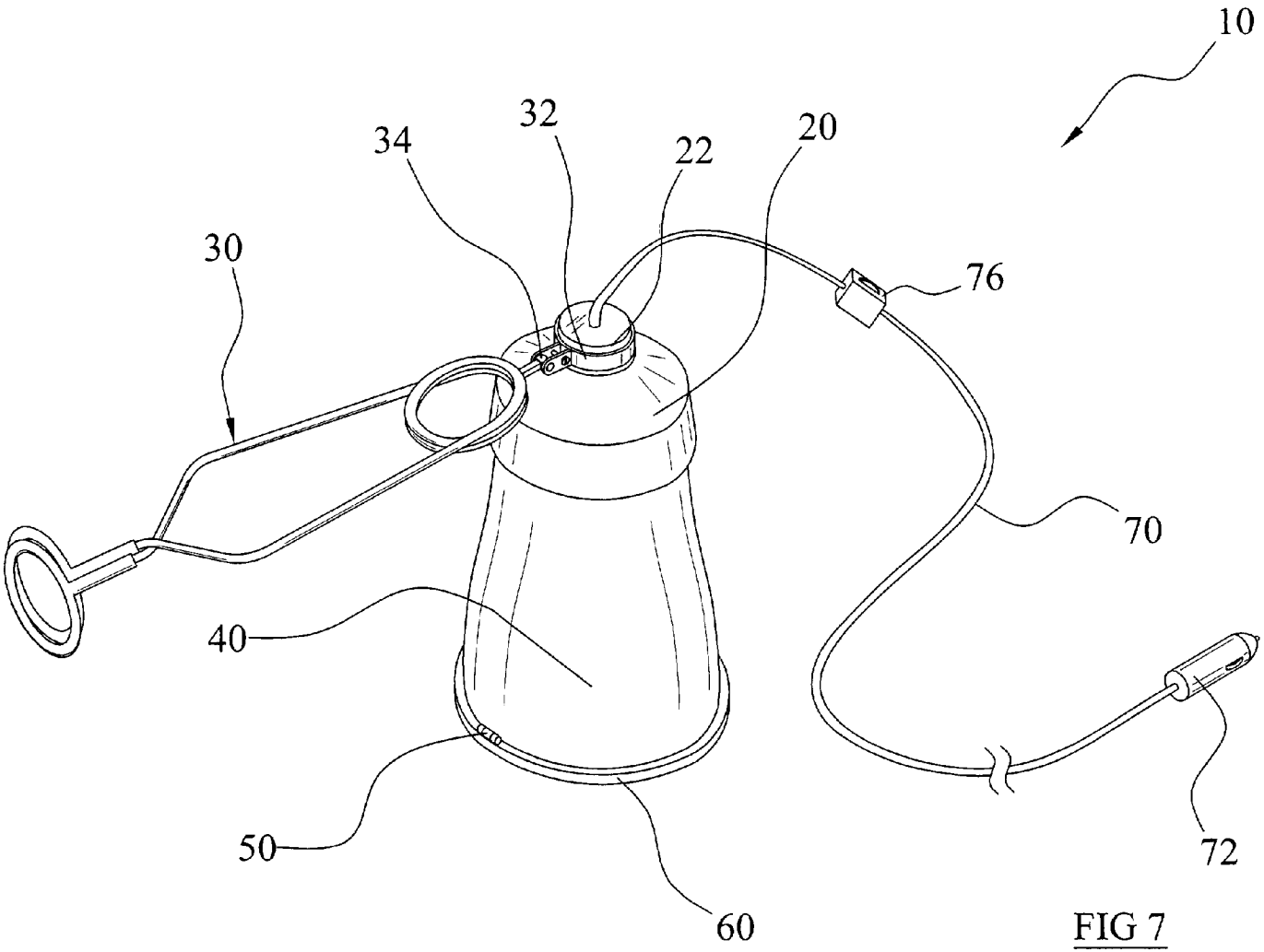
FIG. 7 is an upper perspective view of a second alternative embodiment of the present invention disclosing an inline switch within the power cord.

FIG. 4 of the drawings illustrates the usage of a cord member 24 mechanically connected to a switch within the electrical receptacle within the main housing 20. The cord member 24 is preferably sufficient in length to pass about the light bulb 12, but short enough in length to not extend past the lower end 44 of the bulb housing 40 as further shown in FIG. 4 of the drawings. The user simply pulls upon the cord member 24 to either open or close the switch. As shown in FIG. 5 of the drawings, a power button 26 may be electrically connected to the switch instead of using a cord member 24 for controlling electrical power to the light bulb 12. FIG. 7 illustrates the usage of an inline switch 76.

As shown in FIGS. 1 through 6 of the drawings, a clamp structure 30 is attached to the upper neck 22 of the main housing 20. The clamp structure 30 is preferably comprised of a spring structure with a pair of opposing clamps, however various other clamping devices may be utilized to construct the clamp structure 30.

A collar member 32 is preferably secured about the upper neck 22 of the main housing 20 by tightening a fastener or other tightening device. The clamping arms of the clamp structure 30 are preferably rotatably attached to the collar member 32 via a swivel hinge 34 or similar hinge device for allowing multi-directional movement of the clamp structure 30 in a frictional manner.

As shown in FIG. 3 of the drawings, the bulb housing 40 has an upper end 42 and a lower end 44. The upper end 42 is secured within the main housing 20 via a conventional securing means such as adhesive or fasteners. The lower end 44 of the bulb housing 40 is preferably an open structure and preferably broader than the upper end 42 thereof. The bulb housing 40 is preferably comprised of a transparent or a semi-transparent material which is also flexible such as but not limited to plastic. The bulb housing 40 may also be colored as desired.

Figure 2:
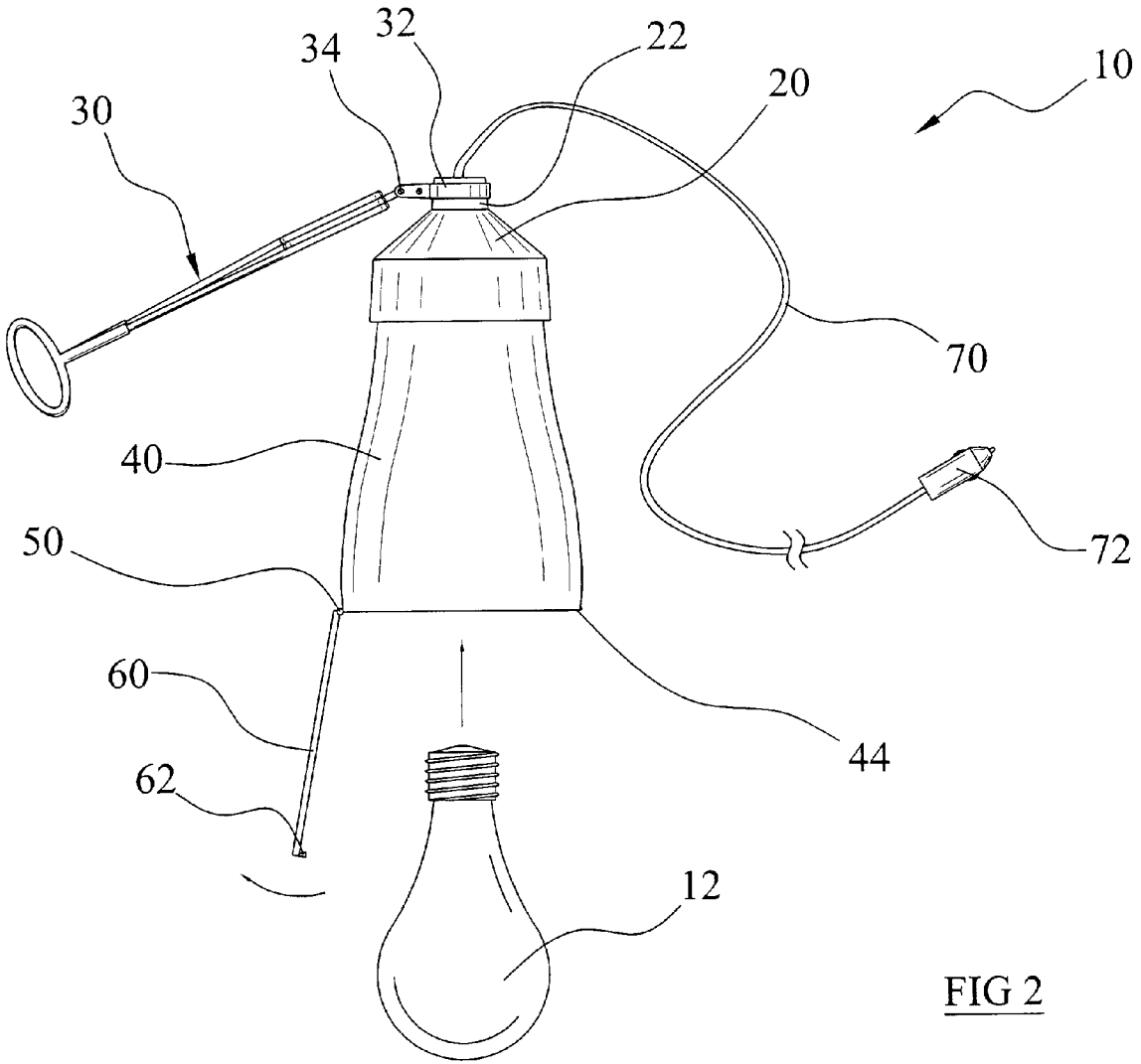
FIG. 2 is a side view of the present invention with a light bulb being inserted.

A cover 60 is pivotally attached to the lower end 44 of the bulb housing 40 via a pivot hinge 50 as best illustrated in FIG. 2 of the drawings. The cover 60 is preferably transparent to allow for increased illumination through the cover 60 when attached to the bulb housing 40, however the cover 60 may be semi-transparent. The cover 60 is preferably comprised of a flexible material such as plastic. A latch 62 extends from the end of the cover 60 opposite of the pivot hinge 50 for selectively engaging the lower end 44 of the bulb housing 40 when the cover 60 is closed upon the bulb housing 40 thereby maintaining the light bulb 12 in a water resistant cavity.

As to a further discussion of the manner of usage of the present invention, the same should be apparent from the above description. Accordingly, no further discussion relating to the manner of usage will be provided.

With respect to the above description then, it is to be realized that the optimum relationships for the components of the invention, to include variations in proportions and manner of use are deemed readily apparent and obvious to one skilled in the art.

Therefore, the foregoing is considered as illustrative only of the principles of the invention. Further, since numerous modifications and changes will readily occur to those skilled in the art, it is not desired to limit the invention to the exact structure and use shown and described, and accordingly, all suitable modifications and equivalents may be resorted to, falling within the scope of the invention.

I claim:

1. A utility lamp system, comprising:

a main housing;

an electrical receptacle within said main housing for receiving a light bulb;

a transparent bulb housing fixedly attached relative to and extending from said main housing about said light bulb;

an openable a cover releasably attached to a distal end of said bulb housing permitting access to said bulb;

a clamp structure attached to said main housing, wherein said clamp structure has a pair of clamp members connected to one another by a spring structure; and a power cord member mechanically connected to said electrical receptacle within said main housing;

wherein said bulb and said electrical receptacle are enclosed in a water resistant cavity when said cover is closed and when said cover is open said bulb is accessible and laterally surrounded and protected by said bulb housing; and wherein light can be transmitted laterally through said surrounding bulb housing to generally flood the area around the lamp system with light.

2. The utility lamp system of claim 1, wherein said cover is transparent.

3. The utility lamp system of claim 1, wherein said cover is semi-transparent.

4. The utility lamp system of claim 1, wherein said cover is pivotally attached to said lower end of said bulb housing, said openable cover including a latch attached to said cover for catchably engaging said bulb housing.

5. The utility lamp system of claim 1, including a cord member positioned within said bulb housing and mechanically connected to a switch within said electrical receptacle.

6. The utility lamp system of claim 1, including a power button positioned within said bulb housing and mechanically connected to a switch within said electrical receptacle.

7. The utility lamp system of claim 1, wherein said cover is transparent and said system includes an adapter unit electrically connected to said power cord electrically connecting to a DC power source.

8. The utility lamp system of claim 1, wherein said cover is colored.

9. A utility lamp system, comprising a main housing;

an electrical receptacle within said main housing for receiving a light bulb;

a transparent bulb housing extending from said main housing about said light bulb for protecting said bulb and permitting light from the bulb to flood the area where the lamp system is being used;

a cover pivotally attached to a distal end said bulb housing;

a latch attached to said cover for catchably engaging said bulb housing, wherein said bulb is enclosed in a water resistant cavity when said cover is closed and said latch is engaged;

a clamp structure attached to said main housing, wherein said clamp structure has a pair of clamp members connected to one another by a spring structure and wherein said clamp structure includes a collar member securable about an upper neck of said main housing and wherein said clamp structure includes a swivel hinge;

a cord member positioned within said bulb housing and mechanically connected to a switch within said electrical receptacle; and a power button positioned within said bulb housing and mechanically connected to a switch within said electrical receptacle.

10. The utility lamp system of claim 9, wherein said cover is transparent.

11. The utility lamp system of claim 10, wherein said system includes a mechanically controllable switch mechanism cooperating with said power cord for controlling electrical power supplied to said bulb.

12. The utility lamp system of claim 11, wherein said clamp structure includes a collar member securable about an upper neck of said main housing.

13. The utility lamp system of claim 12, wherein said clamp structure includes a swivel hinge.

* * * * *